United States Patent [19]

Hacker et al.

[11] Patent Number: 4,503,766

[45] Date of Patent: Mar. 12, 1985

[54] PARTS DEPOSITORY, PARTICULARLY FOR LARGE-AREA WORKPIECES IN A TRANSFER PRESS HANDLING LARGE WORKPIECES

[75] Inventors: Harald Hacker, Weingarten; Ulrich Amann, Baindt; Karl Geisinger, Meckenbeuren; Hans Engelhardt, Baienfurt, all of Fed. Rep. of Germany

[73] Assignee: Maschinenfabrik Müller-Weingarten AG, Weingarten, Fed. Rep. of Germany

[21] Appl. No.: 536,035

[22] Filed: Sep. 26, 1983

[30] Foreign Application Priority Data

Dec. 9, 1982 [DE] Fed. Rep. of Germany ..... 3245603

[51] Int. Cl.[3] ..... B30B 15/30

[52] U.S. Cl. ..... 100/207; 72/405; 72/419; 248/157; 248/550

[58] Field of Search ..... 100/193, 207, 215; 72/405, 419, 422; 248/550, 161, 157

[56] References Cited

U.S. PATENT DOCUMENTS 3,753,489 8/1973 Tomioka ..... 100/207 X

FOREIGN PATENT DOCUMENTS 2104462 12/1971 Fed. Rep. of Germany ..... 72/419

3213381 10/1983 Fed. Rep. of Germany ..... 72/422

*Primary Examiner*—Billy J. Wilhite

*Attorney, Agent, or Firm*—Spencer & Frank

[57] ABSTRACT

The present invention relates to a parts depository particularly for large-area workpieces processed in a transfer press handling large workpieces, with the tool free stage disposed between the machine columns being designed as a so-called empty stage for the deposit of the workpiece parts.

To avoid the manual work previously required to adapt the parts depository to the new workpiece when changing from one workpiece type to another and to make the change as fast and automatic as possible, the present invention proposes to arrange a plurality of supporting elements in the empty stage so as to serve as support for the workpiece part, with the supporting elements being adjustable and settable in height.

3 Claims, 2 Drawing Figures

PARTS DEPOSITORY, PARTICULARLY FOR LARGE-AREA WORKPIECES IN A TRANSFER PRESS HANDLING LARGE WORKPIECES

BACKGROUND OF THE INVENTION

The present invention relates to a parts depository, particularly for large-area workpieces produced in a transfer press for handling large workpieces. Transfer presses of this type work on the material (for example, a vehicle body part) in sequential stages. After lifting the movable die or dies of the press the parts under processing are in unison advanced to the successive stage. In large press constructions it is necessary to support and stabilize the press complex by structural columns, for example, along a midline of the press. As the components are intermittently and in sequence advanced through the press, they reach the column area where no working on the components takes place. This location is referred to as an "empty stage" in which each component has to dwell until, in the next sequential step, it is advanced past the empty stage into a "working stage". These empty stages must be designed in such a manner that the respective workpiece being processed is given a reasonable support for its particular outline.

However, this means that a differently shaped support has to be provided in the empty stage for practically every change in workpiece type processed in the machine. In the past, this has always been done manually and was quite labor intensive.

SUMMARY OF THE INVENTION

It is an object of the invention to provide an improved parts depository which can be adapted at any time in the fastest possible manner and without manual operation to the contour of the respective new workpiece parts.

This object and others to become apparent below, are achieved by the invention, according to which, briefly stated, plurality of adjustable and settable supporting elements are provided in the empty stage of the press to serve as supports for the workpiece part.

According to a preferred embodiment a plurality of pressure medium cylinders are provided as supporting elements, with the piston rods of these cylinders serving as support for the workpiece part.

The piston rods are designed to be adjustable and settable in height. According to another embodiment the pressure medium cylinders are actuated by means of electronic sensors. In another embodiment the supporting elements are lifting spindles or the like, driven by a stepping motor.

According to the present invention the settable supporting elements may be controlled by an electronic program, to thus provide automatically a precise depository for any desired workpiece part.

DETAILED DESCRIPTION OF THE INVENTION

Figure 1:
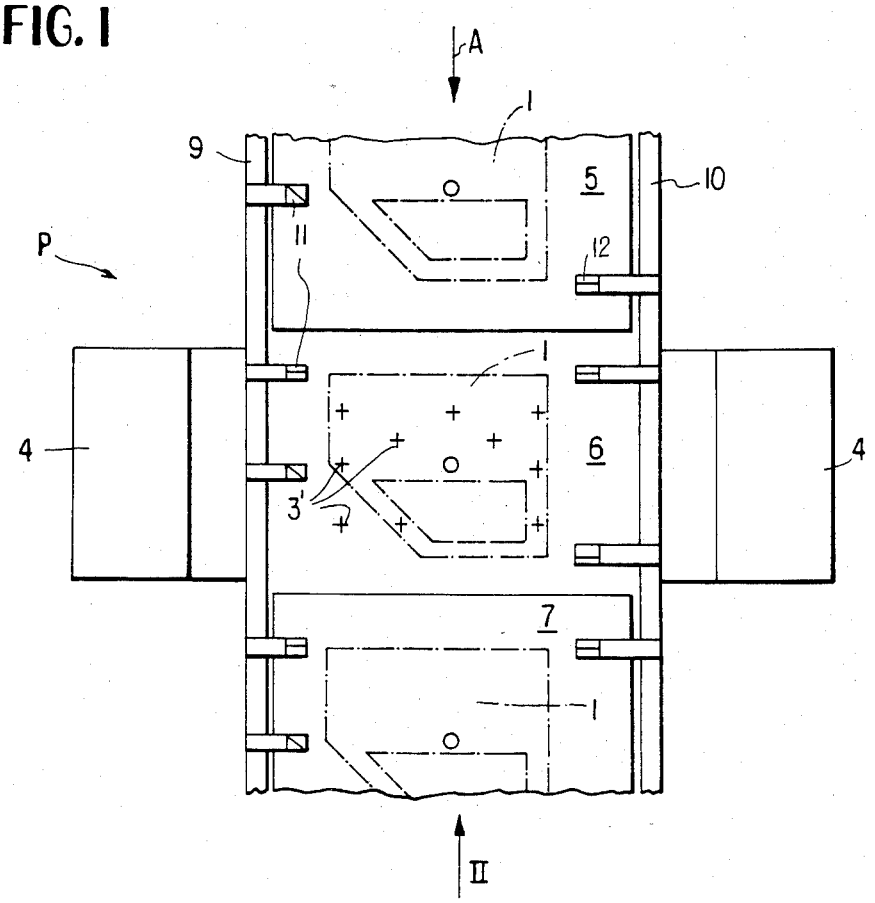
FIG. 1 is a schematic fragmentary top plan view of a transfer press as seen in the direction of arrow I of FIG. 2, including an empty stage accommodating the invention.

Turning to FIG. 1, in a transfer press generally designated at P for large-area workpieces, components 1 of, for example, a vehicle body are sequentially shaped. The components (workpieces) 1 are deformed in sequence in successive work stages, such as work stages 5 and 7. After a deforming step performed by large-area dies which reciprocate in a direction perpendicularly to the plane of drawing FIG. 1, a transporting mechanism, for example, of the type having gripper rails 9 and 10 equipped with gripper fingers 11 and 12 (all of conventional construction), are advanced to the successive stage in the direction of the arrow A.

The press P includes support columns 4 approximately at midlength of the press. In the zone of the support columns 4 no working stage is provided; rather, this zone includes an "empty stage" 6 which is void of shaping tools. Since the empty stage 6 is situated between two working stages 5 and 7, each article 1, as the intermittent advancing thereof is performed, dwells in the empty stage, until, during the successive advancing step, it is forwarded to the working stage 7. Simultaneously, the empty stage receives a new workpiece 1 from the working stage 5.

In order to hold the article which dwells in the empty stage 6, a particular support structure has to be provided which, for ensuring a deformation-free positioning, must generally conform to the topography of the workpiece surface oriented downwardly, towards the support structure. In prior art arrangements, as was noted before, each time the workpiece configuration was changed, a correspondingly shaped, entirely separate support structure had to be provided.

Figure 2:
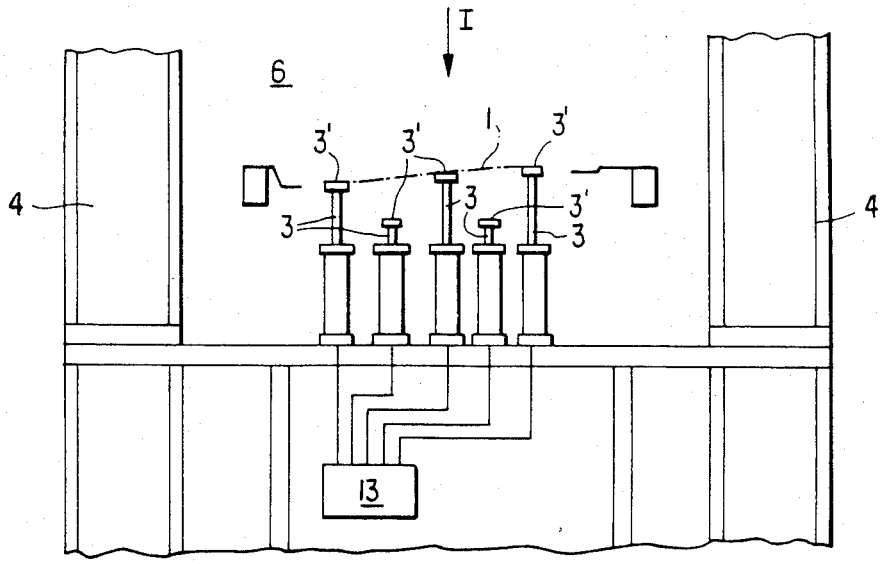
FIG. 2 is a schematic fragmentary side elevational view of the transfer press as seen in the direction of arrow II of FIG. 1, illustrating a preferred embodiment of the invention.

Also turning now to FIG. 2, there is illustrated a preferred embodiment of a support structure according to the invention for holding (propping up) workpieces which dwell in the empty stage 6. The support structure or assembly according to the invention is formed of a plurality of individual support elements, each having vertically adjustable rod-like parts whose upper terminus serves as one of a plurality of support points (small support areas) for the workpiece 1. In the embodiment shown in FIG. 2, the supporting elements are pressurized fluid operated cylinder-and-piston units, each formed of a power cylinder 2 and an associated piston (not visible) having a piston rod 3 projecting vertically upwardly from the respective cylinder 2. The upper terminus of each piston rod 3 is formed as a contacting face 3' for engaging the workpiece 1 (shown in dash-dot lines). Viewing FIGS. 1 and 2 together, there are shown ten cylinder-and-piston units distributed over an area in the empty stage 6 which is intended for accommodating the workpiece 1.

The piston and piston rod 3 of each power cylinder 2 is height adjustable by appropriate pressurization of the respective cylinder to ensure that the contacting faces 3' as a whole generally follow the contour (topography) of the workpiece surface to be positioned. In a simplest solution which is based on the invention, the piston rods 3 may be individually and separately adjusted.

It is, however, a more efficient utilization of the invention to provide a program-controlled height adjustment of the support elements 2, 3. All the support elements 2, 3 may be electronically controlled based on desired height values for the piston rod determined in accordance with the particular topography of the workpiece and height setting for each element is effected by an electronic comparison between signals representing desired and actual displacements. For this purpose, expediently, the support elements are of the conventional type in which the displacement of the piston rod is automatically sensed by electronic means. FIG. 2 thus schematically illustrates a support element control 13 which symbolizes setting the values for the individual piston rods 3 as well as a programmed control.

Instead of pressurized fluid operated support elements, it is within the scope of the invention to provide individual spindle units where threaded spindles are rotated, for example, by stepping motors advantageously controlled by an electronic program.

As seen in FIG. 2, dependent upon the configuration of the workpiece to be supported, some of the support elements may be inactive, and thus withdrawn into an inoperative position.

It will be understood that the above description of the present invention is susceptible to various modifications, changes and adaptations, and the same are intended to be comprehended within the meaning and range of equivalents of the appended claims.

What is claimed is:

1. In a transfer press for a stepwise deformation of workpieces, including a plurality of stages arranged in a series, means for intermittently advancing the workpieces from one stage to a successive stage; some of said stages being working stages for deforming the workpieces; at least one of said stages being an empty stage void of workpiece-deforming means; support means arranged in said empty stage for supporting a workpiece while the workpiece dwells in said empty stage; the improvement wherein said support means comprises a plurality of supporting elements distributed over a zone intended to accommodate a workpiece; each said support element having a vertically oriented member including an upper terminus forming an engagement area for contacting the workpiece at locations spaced from one another; each vertically oriented member being vertically adjustable for setting the engagement areas arbitrarily to generally conform to topographical characteristics of the workpieces.

2. A transfer press as defined in claim 1, further comprising control means coupled to each said support element for a programmed control of a vertical position of said vertically oriented member.

3. A transfer press as defined in claim 1, wherein said support elements comprise pressurized fluid cylinder units and further wherein each vertically oriented member is a piston rod projecting from a respective said cylinder.

* * * * *